United States Patent [19]

Nestrock

[11] 4,098,304

[45] Jul. 4, 1978

[54] LIQUID-DISPENSING VACUUM BOTTLE OR THE LIKE

[75] Inventor: Frederick L. Nestrock, Avon, Conn.

[73] Assignee: Union Manufacturing Company, Meriden, Conn.

[21] Appl. No.: 760,016

[22] Filed: Jan. 17, 1977

[51] Int. Cl.[2] ..... B65B 3/04

[52] U.S. Cl. ..... 141/84; 141/375; 137/625.19

[58] Field of Search ..... 141/285-302, 141/369-381, 84, 98; 137/625.19

[56] References Cited

U.S. PATENT DOCUMENTS 3,334,668 8/1967 Allen ..... 141/392

FOREIGN PATENT DOCUMENTS 424,001 1/1926 Fed. Rep. of Germany ..... 141/369

*Primary Examiner*—Houston S. Bell

*Attorney, Agent, or Firm*—Hopgood, Calimafde, Kalil, Blaustein & Lieberman

[57] ABSTRACT

The invention contemplates means importantly including a combined spigot and plug for removable sealed attachment to a vacuum bottle or the like for enabling selective spigot dispensing of the contents of such a bottle mounted in inverted position. The invention features simplicity of molded-plastic spigot and plug elements.

15 Claims, 5 Drawing Figures

LIQUID-DISPENSING VACUUM BOTTLE OR THE LIKE

This invention relates to structure to enable selective spigot dispensing of the liquid contents of a vacuum or the like bottle.

It is an object of the invention to provide improved structure of the character indicated, adapted for sealed assembly to the mouth of a vacuum bottle.

Another object is to provide a kit of adapter parts enabling a conventional vacuum bottle to be fixedly mounted in inverted orientation and with an exposed spigot for selective gravity-dispensing of liquid contents of the bottle.

A general object is to meet the above objects with simple, rugged and easily cleaned structure, which has inherently superior liquid-sealing properties and which is inherently adapted to fixed mounting in a vehicular environment of relatively severe mechanical shock and vibration.

Other objects and various further features of novelty and invention will be pointed out or will occur to those skilled in the art from a reading of the following specification in conjunction with the accompanying drawings. In said drawings, which show, for illustrative purposes only, a preferred form of the invention:

Figure 1:
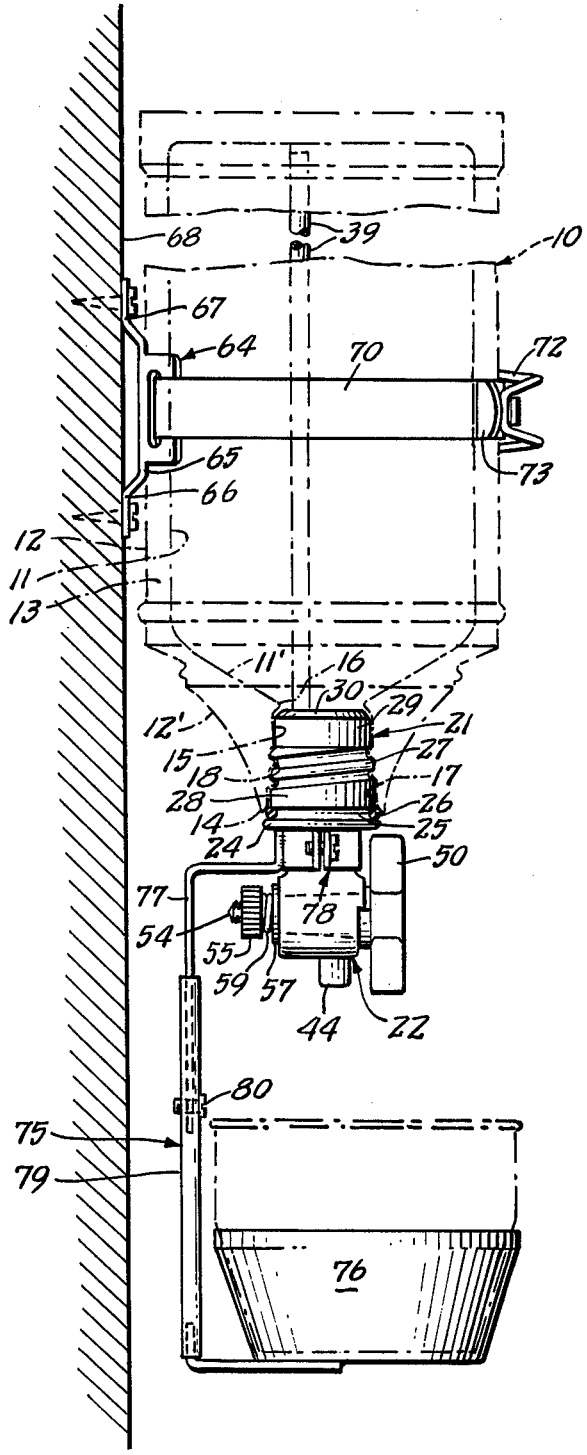
FIGS. 1 and 2 are respectively left-side and front elevations of mounting and liquid-dispensing structure of the invention, shown in the partly phantom-outline context of a vacuum bottle to which such structure is assembled.
Figure 2:
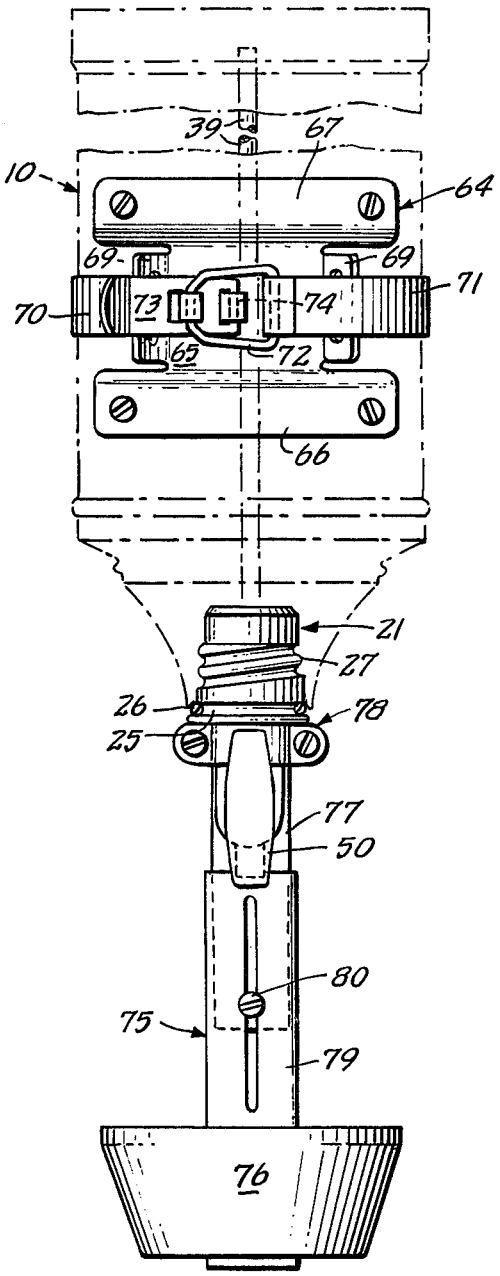

The invention is shown in application to a vacuum bottle 10 which is indicated in phantom overall outline in FIGS. 1 and 2. The bottle 10 is of the variety having inner and outer envelopes 11–12 which define an evacuated annular insulating space 13 therebetween; both envelopes converge (at 11′–12′) in spaced relation at the openable or dispensing end of the bottle and are connected in permanently sealed relation at the region of a circumferentially continuous dispensing lip 14. The throat of the dispensing end is defined by local contouring of the convergent end 11′, being specifically shown to include a reduced first cylindrical portion 15, between an axially inner, inwardly projecting head 16, and a second and larger cylindrical portion 17 joined to clindrical portion 15 by thread formations 18; at its axially outer end, cylindrical portion 17 is flared outwardly to enable the sealed connection to outer envelope 12, at lip 14.

The conventional bottle 10 thus far described is made of drawn and spun stainless-steel envelopes (11–12), secured and sealed at 14, and the conventional employment of bottle 10 is to effect closure by means of an externally flanged threaded plug, having contoured profile features to engage threads 18 and to establish coaxial piloting on the spaced cylindrical portions 15–17. It is such a plug which is replaced by spigot structure of the invention.

Figure 3:
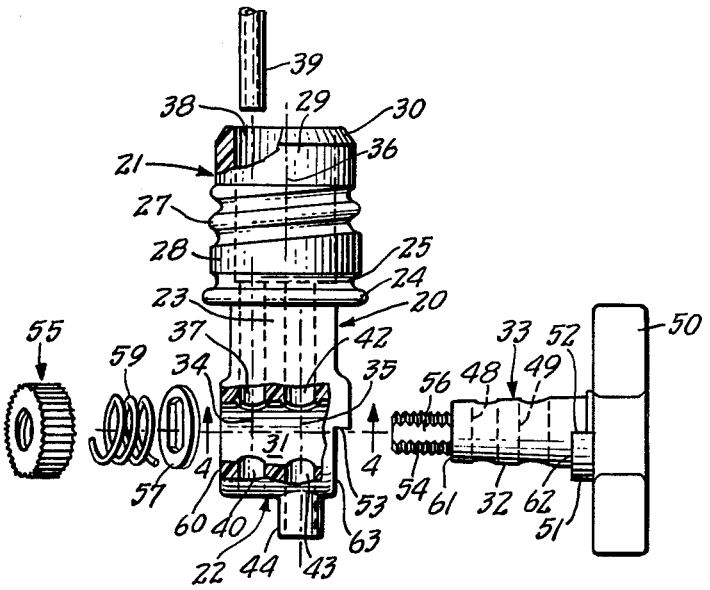
FIG. 3 is an exploded view, generally in side elevation, of parts of the combined plug and spigot of my invention, certain parts being broken away and in section, and certain others being in perspective.

The spigot structure of the invention (see FIG. 3) comprises a body member 20 which is a single-piece injectionmolded product of a suitable thermoplastic material, such as polypropylene. Body member 20 consists generally of a plug end 21, a spigot end 22, and an intermediate connecting length 23 therebetween. At the plug end 21, a short radial or base flange 24 defines a wall of circumferential seating groove 25 for retaining an elastomeric O-ring seal member 26 (FIGS. 1 and 2), and threads 27 between cylindrical regions 28-29 conform to and engage the bottle-throat formations 18-17-15 already described. The arrangement is such that in normal threadsecured closure of the bottle, flange 24 compresses seal member 26 against lip 14, in the circumstance of relatively small axial clearance between bead formation 16 and an end bevel 30 of plug end 21; should the seal ring 26 become lost, the arrangement is further such that thread-secured closure is established by circumferential continuous contact of bevel 30 to bead 16, with an axial clearance between flange 24 and lip 14.

Figure 4:
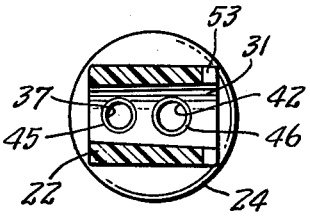
FIG. 4 is a sectional view taken at the plane 4—4 of FIG. 3.

The connecting portion 23 of body member 20 is of reduced but substantially constant cross-section, preferably rectangular, for a locking purpose to be described, being reduced with respect to the plug-end section at 24 and with respect to the adjacent enlarged generally rectangular body section of the spigot end 22 (see FIG. 4). The body section at 22 is characterized by a transverse opening 31 which is gently tapered, as at an included angle in the order of 5°, to receive the correspondingly tapered stem portion 32 of a spigot member 33.

The body member 20 is further characterized by two spaced passages on axial alignments 34–35 which are parallel to the axis 36 of member 20. Both these alignments 34–35 intersect the axis of transverse opening 31, and the respective passages associated therewith are both open to the respective ends of body member 20. On the axis 34, an upper vent-passage portion 37 is established between opening 31 and the base of a cup-like cavity 38; the passage portion 37 is sized for removable but snug-fitting reception of one end of a relatively stiffly compliant plastic vent tube 39, as will be later explained.

On the other side of opening 31, and also on axis 34, a lower vent-passage portion 40 is established between opening 31 and the exterior of lower body end 22. In similar fashion, on the axis 35, an upper liquid-discharge passage portion 42 is established between opening 31 and the base of cavity 38; and on the other side of opening 31, and also on axis 35, a lower liquid-discharge passage portion 43 is established between opening 31 and the lower end of a downwardly projecting discharge nozzle formation 44. The aligned passage portions 42–43 are preferably of the same bore diameter, and this diameter preferably exceeds that of the upper vent-passage portion 37, so that, upon insertion, vent tube 39 will be retained in the vent passage but not in the liquid-discharge passage. Preferably also, small but circumferentially continuous bead formations 45–46 ring each of the upper passage portions 37–42 at their respective intersections with the tapered bore of transverse opening 31; for the case of a bore 31 which tapers from $\frac{5}{8}$ inch to $\frac{1}{2}$ inch, and for passages 37–42 of $\frac{1}{4}$ inch and 5/16 inch diameters, respectively, each of the bead formation 45–46 may be of approximately 1/16 inch radial width, projecing approximately 0.015 to 0.020 inch radially inwardly of the geometric cone which otherwise defines the tapered opening 31. It will be appreciated that the function of bead formations 45–46 is to assure initial and primary interference between formations 45–46 and stem body 32 when the latter is assembled to tapered opening 31, the compressive force of the interference being sufficient to cause such transient compliant local deformation of bead formations 45–46 as to assure circumferentially continuous integrity of a separate seal for each of passages 37–42 at its interface with stem 32.

To coact with the desired vent and discharge passages of body member 20, the stem 32 of spigot member 33 is shown with corresponding parallel passages 48–49 on alignments which register with passages 33–40 and 42–43, when stem 32 is in its passage-open position. A 90° rotaton of stem 32 from such open position places smooth surface regions of stem 32 against both bead formations 45–46, to effectively close both vent and discharge communication with the interior of the bottle 10.

The spigot member 33 is also preferably a single-piece injection-molded product of a suitable thermoplastic material such polypropylene. At the larger end of its stem 32, member 33 comprises externally accessible actuating means such as a handle 50 having a hub 51 which is locally recessed as at 52 to coact with a similar local formation 53 in the adjacent assembled region of body member 20; the formations 52–53 will be understood to provide 90 degree spaced limits of angular lost motion for handle-actuated rotation of stem 32, with one limit representing the open condition of passage alignments (37-40-40, and 42-49-43), and with the other limit establishing the closed condition of passages 37 and 42. Also, it will be understood that in both of these selected limiting positions, each of the bead formation 45–46 performs its circumferentially continuous seal function, assuring integrity of each of the vent and discharge passages in both the open and closed conditions thereof.

At its smaller end, the spigot member 33 has a reduced integral axial projection 54 which is externally threaded to accept adjusted advance of a securing nut 55. Opposed local flats 56 in the reduced projection 54 coact with opposed flats in the central opening of a washer 57 to enable an axially movable but keyed relation between washer 57 and spigot member 33. Finally, a coil spring 59, which locates at one end within the cupped adjacent end of nut 55, compressionally preloads washer 57 against the adjacent flat surface 60 of body member 20. In this circumstance, and with spigot-member shoulders at 61–62 in axial-clearance relation with washer 57 and with adjacent body-member surface 63, spring 59 axially loads stem 32 into bead-sealing relation at 45–46, as will be understood.

To complete the description and to ready the thus-equipped bottle 10 for use, first bracket means 64 is employed to removably anchor bottle 10 in the inverted position shown in FIGS. 1 and 2. As shown, bracket-means 64 is of formed sheet metal and comprises a central platform 65 in slightly offset relation to spaced mounting feet 66–67, which may be bolted or otherwise secured to a fixed vertical mounting surface 68. Between the feet 66–67, and in outwardly bowed or dished aray, two stabilizing ears 69 project from platform 65, for tangential engagement with the cylindrical body of an applied bottle 10. Each of the ears 69 has an elongate slot, for removable reception of the hooked end of one of two clamping straps 70–71; the outer ends of straps 70–71 are equipped with hasp means comprising a bail 72 and a hooked lever 73 articulated (at pin 74) past its dead-center position for securely clamped retention of bottle 10.

Second bracket means 75 is removably secured to and suspended from the intermediate region 23 of body member 20 and provides a pan 76 to hold and position an inserted drinking cup, beneath the discharge nozzle 44. As shown, a first vertical arm 77 has an upper radial offset which carries the removable clamp means 78 by which bracket means 75 is suspended from body member 20. In telescoped and guided assembly to arm 77 is a second arm 79 with a lower radial offset which mounts the pan 76; a bolt 80 adjustably secures a desired elevation of pan 76 beneath nozzle 44.

Figure 5:
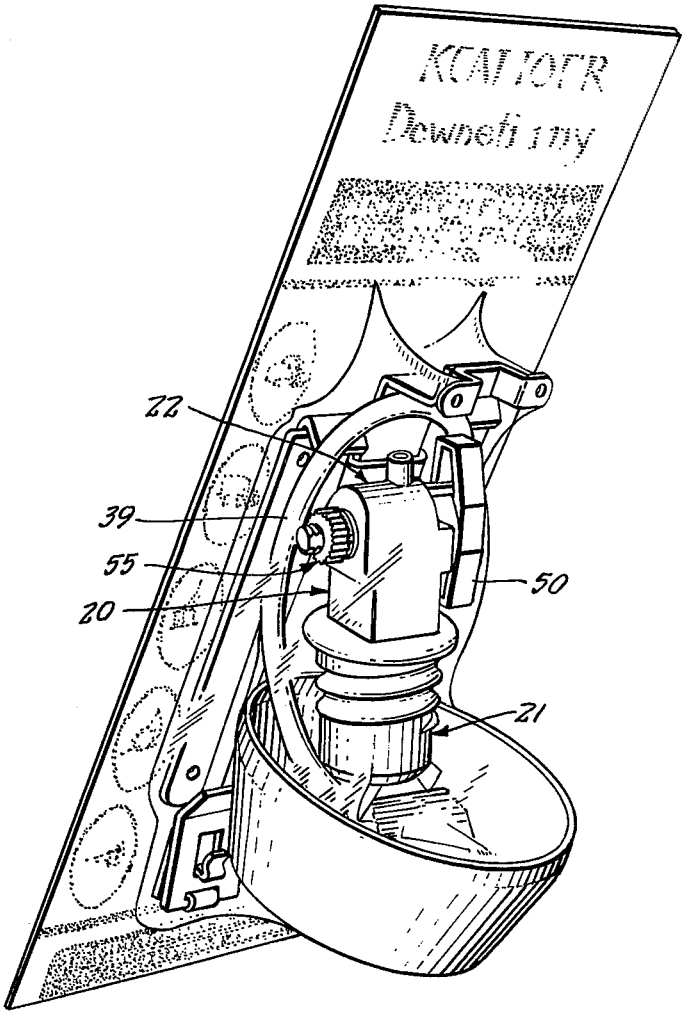
FIG. 5 is a simplified perspective view of a kit embodying bottle-conversion parts of the invention.

FIG. 5 illustrates the provision of the described combined plug and spigot (e.g., as in FIG. 3), and the described first and second bracket means 64–75 as a kit, to provide full convertability of the conventional vacuum bottle 10 into a fixedly mounted dispensing bottle. The parts are simple and few, and are all separable from each other for utmost convenience in cleaning. All parts of the kit may be mounted to a combined display and instructions card 81, as shown in FIG. 5, wherein a slumped transparent plastic sheath 82 is draped over the card 81 and the individual parts, and then heat-sealed to card 81, to retain the displayed array.

The described dispenser and kit will be seen to have met all stated objects and to have provided a greatly extended range of useful application for vacuum or the like bottles. The construction is found to be so rugged as to easily withstand an extreme vibrational or mechanically shocked mounting, as to the wall of a truck cab or to the body of a snowmobile, trailer home, boat or light airplane. In the presence of such mechanical shock, the compliant nature of the inserted vent tube 39 is such as to yield and thus to avoid development of any seal-weakening at the described plug-to-bottle engagement or at the described stem (32) to bead (45–46) engagements. The torsional friction at compression of ring 26 between flange 24 and lip 14 is found to hold against undesired dislodgement of the plugged relationship, in spite of a vibrational environment.

As a further convenience feature, it will be noted that pan 76 may be contoured for nested reception and retention of the closure cup (phantom outline in FIG. 1) which forms part of the original vacuum-bottle closure. Such closure cup may be insulated, for maintenance of beverage temperature, and may of the construction shown and described in U.S. Pat. No. 3,627,162; and clearly a cup thus retained at 76 will be undisturbed even by extreme vehicular motion.

While the invention has been described in detail for the preferred form shown, it will be understood that modifications may be made without departure from the scope of the invention.

What is claimed is:

1. A combined spigot and plug for unitary inserted closure of the open end of a thermos or the like bottle, said combined spigot and plug comprising a unitary single-piece injection-molded plastic body member extending between a plug end and a spigot end on essentially a single axis, said plug end having a circumferentially extending base flange for limiting the longitudinal extent of plug insertion into a bottle neck, said plug end having external thread formations for threaded engagement to corresponding formations in the bottle neck, and said plug end having a circumferential seal-retaining groove between said flange and said thread formations, said body member having two spaced straight parallel passages extending longitudinally through both said ends and a single tapered spigot opening intersecting both said parallel passages and extending transversely through said body member near the spigot end thereof; a single-piece injection-molded plastic spigot member comprising a tapered stem having liquid-sealing but rotatable fit in the spigot opening, said spigot member having two axially spaced straight parallel passages extending transversely through said stem at the respective regions of spigot-opening intersection with said body-member passages, and said spigot member including externally projecting manualactuating means at the larger end of said stem and externally projecting threads at the smaller end of said stem; a vent tube connected to said body member at one of said body member-passages and extending axially beyond the plug end of said body member; and an externally accessible nut engaged to the threads of said spigot member and having compressional reference to the adjacent surface of said body member to hold said liquid-sealing but rotatable fit.

2. The combined spigot and plug of claim 1, wherein a compression spring is interposed between said nut and body member to resiliently hold said liquid-sealing but rotatable fit.

3. The combined spigot and plug of claim 1, wherein said body-member passages are of different bore diameters, the larger one of said body-member passages being near the larger end of said tapered stem, and said vent tube communicating with the smaller one of said passages.

4. The combined spigot and plug of claim 3, in which said body member includes an integrally formed dispensing nozzle portion for the larger passage and extending radially beyond the nearby open end of the smaller passage.

5. The combined spigot and plug of claim 1, additionally including an elastomeric O-ring seal member seated in said groove and adjacent said flange.

6. The combined spigot and plug of claim 1, in which said body member has a central elongate region of substantially constant external contour for bracket-mounting accommodation between said plug end and said spigot end.

7. The combined spigot and plug of claim 6, and including bracket means secured to said central region and extending longitudinally beyond said spigot end in radially offset relation to said body member, said bracket means including a cupped member mounted in longitudinal offset from said spigot end and having its open end in substantial axial registry with said body-member passages.

8. The combined spigot and plug of claim 1, in which said body member and said spigot member have integral lostmotion abutments angularly limiting spigot stem rotation to and between (1) an open condition of alignment of corresponding stem and body passages and (2) a closed condition of stem blockage of both said body-member passages.

9. The combined spigot and plug of claim 1, in which said vent tube is removably connected to said body member.

10. The combined spigot and plug of claim 1, in which the spigot opening is locally formed with a circumferentially continuous integral bead at the region of intersection with the plug portion of the unvented one of the body-member passages.

11. The combined spigot and plug of claim 10, in which the spigot opening is additionally locally formed with a further circumferentially continuous integral bead at the region of intersection with the plug portion of the ventconnected one of the body-member passages.

12. A combined spigot and plug for unitary inserted closure of the open end of a thermos or the like bottle, said combined spigot and plug comprising a unitary single-piece injection-molded plastic body member extending between a plug end and a spigot end on essentially a single axis, said plug end having a circumferentially extending base flange for limiting the longitudinal extent of plug insertion into a bottle neck, and said plug end having a circumferentially continuous seal-supporting surface adjacent said flange, said body member having two spaced straight parallel passages extending longitudinally through both said ends and a single tapered spigot opening intersecting both said parallel passages and extending transversely through said body member near the spigot end thereof, a single-piece injection-molded plastic spigot member comprising a tapered stem having liquid-sealing but rotatable fit in the spigot opening, said spigot member having two axially spaced straight parallel passages extending transversely through said stem at the respective regions of spigot-opening intersection with said body-member passages, said spigot member including externally projecting manual-actuating means at the larger end of said stem, and axially projecting clamp-receiving means at the smaller end of said stem; a vent tube connected to said body member at one of said body-member passages and extending axially beyond the plug end of said body member; and externally accessible clamp means having removable engagement to said clamp-receiving means and having axially compressional reference to the adjacent surface of said body member to hold said liquid-sealing but rotatable fit.

13. A kit for converting a bottle with a threaded-neck opening into a dispensing bottle, said kit comprising a combined spigot and plug, a wall-mounting bracket including selectively operable bottle-clamping means, and a plastic vent tube; said combined spigot and plug being adapted for unitary inserted closure of a bottle from which liquid is to be dispensed when inverted, said combined spigot and plug comprising a single-piece injection-molded plastic body member extending between a plug end and a spigot end on essentially a single axis, said plug end having means including external thread formations for removable sealed engagement to the neck-opening threads, said body member having two spaced straight parallel passages freely communicating longitudinally with both said ends and a single tapered spigot opening intersecting both said parallel passages and extending transversely through said body member near the spigot end thereof, said combined spigot and plug further comprising an injection-molded plastic spigot member having liquid-sealing rotatable fit in the spigot opening, and said spigot member having two spaced straight parallel passages extending transversely through said stem at the respective regions of spigot-opening intersecton with said body-member passages; and one end of said vent tube having removable liquid-sealed fit to said body member for sealed communication with one to the exclusion of the other of the body-member passages via the plug end of said body member.

14. The kit of claim 13, additionally comprising a cup-holding bracket including selectively operable means for clamping the same to said body member.

15. The kit of claim 14, for conversion of a vacuum bottle having a removable drinking-cup closure, wherein said cup-holding bracket includes a cupped upwardly open pan contoured for nested reception of the drinking-cup closure of the bottle.

* * * * *